US005661910A

United States Patent [19]

Schepisi

[11] Patent Number: 5,661,910

[45] Date of Patent: Sep. 2, 1997

[54] HAND HELD BLOW DRYER HAVING AIRFLOW CONTROL MEANS

[75] Inventor: Natale Schepisi, Mamaroneck, N.Y.

[73] Assignee: Vital Hair Tools, LLC, Mamaroneck, N.Y.

[21] Appl. No.: 697,129

[22] Filed: Aug. 20, 1996

Related U.S. Application Data

[63] Continuation-in-part of Ser. No. 576,592, Dec. 21, 1995.

[51] Int. Cl.[6] ..... A45D 20/10

[52] U.S. Cl. ..... 34/97; 34/96

[58] Field of Search ..... 34/96, 97

[56] References Cited

U.S. PATENT DOCUMENTS

| | | | |
|---|---|---|---|
| 4,097,722 | 6/1978 | Soler et al. | 219/368 |
| 4,218,608 | 8/1980 | Maroney | 219/368 |
| 4,232,454 | 11/1980 | Springer | 34/97 |
| 4,525,623 | 6/1985 | Da Silva | 219/373 |
| 5,148,512 | 9/1992 | Owens | 392/383 |
| 5,157,757 | 10/1992 | McDougall | 392/383 |
| 5,467,540 | 11/1995 | Bastien | 34/97 |
| 5,507,103 | 4/1996 | Merritt | 34/97 |

*Primary Examiner*—Henry A. Bennett
*Assistant Examiner*—Dinnatia Doster
*Attorney, Agent, or Firm*—Oblon, Spivak, McClelland, Maier & Neustadt, P.C.

[57] ABSTRACT

A hand held blow dryer includes a barrel with a plurality of holes. A deflecting mechanism can be positioned within or substantially within the barrel, and an actuating mechanism can be operationally associated with the deflecting mechanism. The hand-held blow dryer can be utilized in at least a first mode in which air flow is directed through the barrel opening of the barrel, and a second mode in which the actuating mechanism is actuated to move the deflecting mechanism from at least a position in which the barrel opening is opened, to a position in which the barrel opening is substantially closed by the deflecting mechanism. Thus, in the second mode most of the air is deflected by the deflecting mechanism and forced through the holes of the barrel.

32 Claims, 14 Drawing Sheets

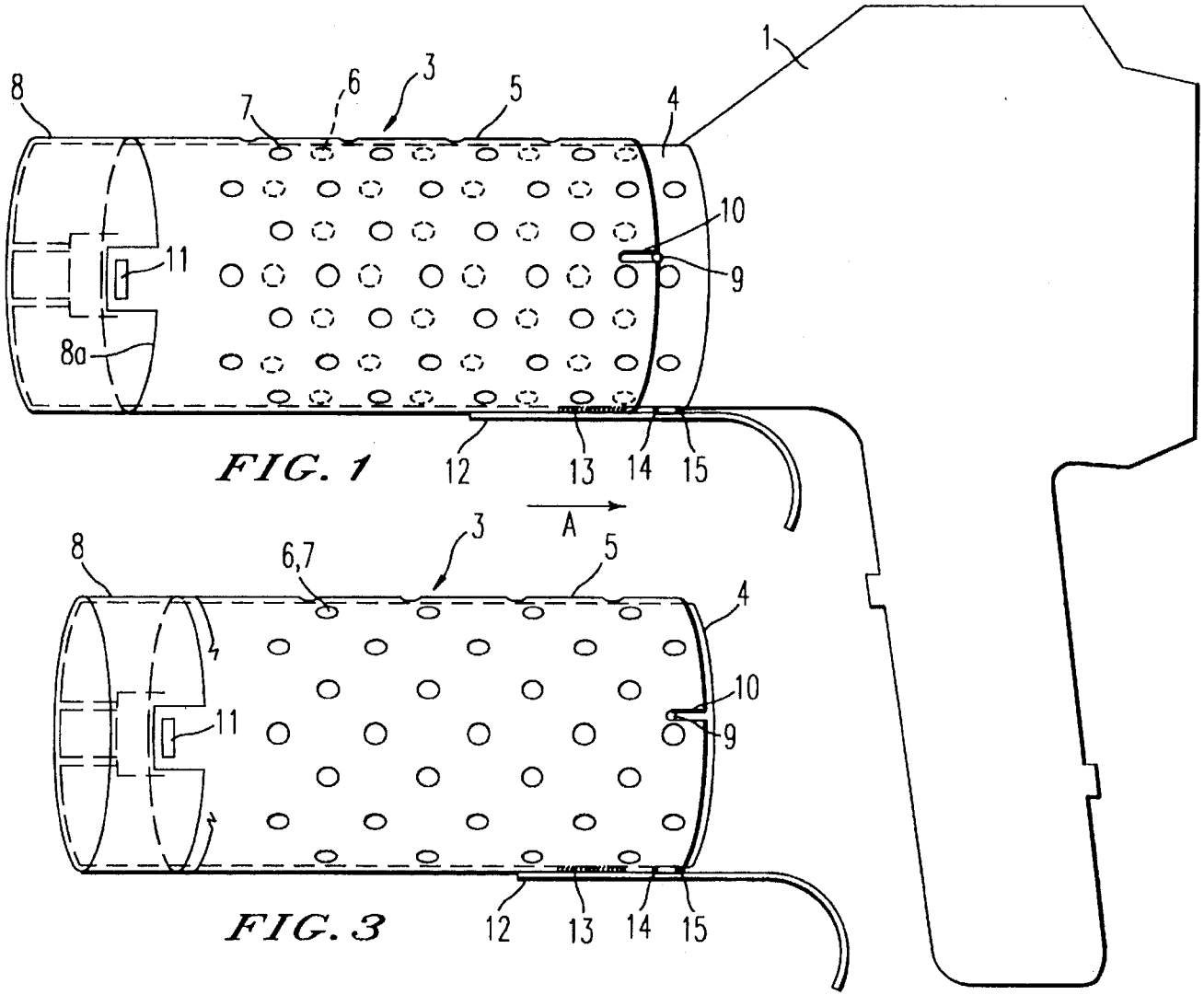
FIG. 1
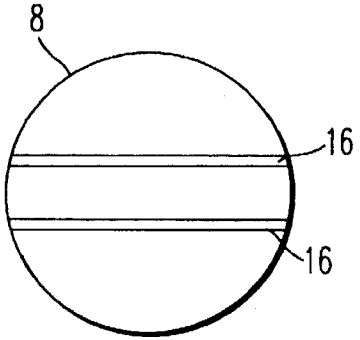
FIG. 2
FIG. 3
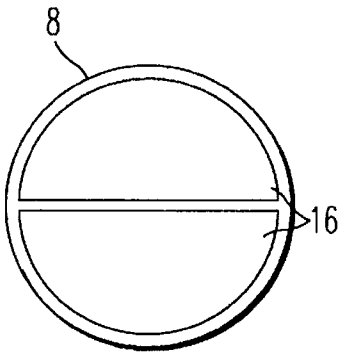
FIG. 4

A
1
3
4
5
5a
6
7
8
8a
11
12
16
16'
16"
16a
16b
16c

HAND HELD BLOW DRYER HAVING AIRFLOW CONTROL MEANS

The present application is a continuation-in-part application of parent application Ser. No. 08/576,592 filed Dec. 21, 1995.

BACKGROUND OF THE INVENTION

1. Field of the Invention

The present invention provides for an enhancement to a professional hair dressing blow dryer, more specifically to the blow dryer's barrel which permits variable airflow and saves energy.

2. Discussion of the Related Art

Conventional hair dressing "pistol-type" blow dryers utilize a one-directional airflow through a front opening of a cylindrical conduit or barrel of the blow dryer. Commercial attachments which are available to fit over the barrel opening to vary airflow require a two-handed operation.

U.S. Pat. No. 4,097,722 describes a mechanism for varying airflow by controlling an area of the barrel opening by a deflector which is activated by the trigger. However, this patent does not disclose airflow from the barrel surface itself.

U.S. Pat. No. 4,232,454 controls airflow from the barrel opening by the use of trap doors activated by a knob and a screw. This has a drawback in that it also requires a two-handed operation.

U.S. Pat. No. 5,157,757 describes variations of airflow, including secondary outlets on a barrel. However, this device like the remaining devices requires a two-handed operation, since full activation depends upon manual rotation of a collar, manual settings, as well as a trigger-operated baffle to vary the barrel opening.

During hair styling utilizing a blow dryer, hair dressers use the blow dryer in one hand and point the barrel opening at the hair to be styled. A brush or other styling tool is utilized in the other hand. Additionally, when blow styling medium to long length hair, hair dressers use the barrel horizontally with the barrel opening pointed away from the head, to lift hair for the subsequent insertion of the tool in the other hand. During this function, air flow from the barrel opening is wasted, and the barrel itself affords no benefit of any drying/styling capability.

Thus, conventional blow dryer devices do not provide for a barrel arrangement in which air can be directed through the barrel surface of the blow dryer. Additionally, conventional blow dryer devices do not provide for an efficient mechanism which permits a user to deflect air flow from the opening of the barrel, and simultaneously direct air flow through the barrel surface of the blow dryer by using a simple one-handed operation.

SUMMARY OF THE INVENTION

The present invention therefore provides for a blow dryer arrangement which overcomes the drawbacks of conventional arrangements discussed above.

The blow dryer arrangement of the present invention adds functionality to the blow dryer by varying airflow from the barrel surface, while conserving energy use. This permits the blow dryer of the present invention to be utilized for horizontal lifting/drying/styling, as well as a hot roller and diffuser.

The blow dryer arrangement of the present invention can incorporate holes on the barrel surface and include a deflector associated with the barrel. By actuation of an actuator, the deflector associated with the barrel can gradually close down most of the airflow in varying degrees. This effects airflow from holes on the barrel in varying degrees, as well as some diffused air from the front opening.

The present invention therefore provides for a blow dryer which comprises a body including a barrel having a barrel opening, with the barrel including a plurality of holes; a deflector positioned within the barrel, the deflector being movable between at least an open position in which the barrel opening is opened, and a deflecting position in which the barrel opening is substantially closed; and an actuator operationally connected to the deflector for moving the deflector between at least the open position and the deflecting position.

The present invention also provides for a blow dryer which comprises a body including a barrel having a barrel opening with the barrel comprising concentric inner and outer cylinders each having a plurality of holes; and an actuator operationally connected to one of the inner or outer cylinders for moving the one of the inner or outer cylinders with respect to the other one of the inner or outer cylinders between at least a first position in which the holes on the inner and outer cylinders are not aligned and a second position in which the holes on the inner and outer cylinders are aligned.

The present invention also provides for a blow dryer which comprises a body including a barrel with a plurality of first holes and a barrel opening; a cylinder movably mounted on the barrel and having a plurality of second holes; and a deflector positioned within the barrel and movable between at least an open position in which the barrel opening is opened and a deflecting position in which the barrel opening is substantially closed.

The present invention also provides for a blow dryer which comprises a body including a barrel having an opening, the barrel defining first and second concentric cylinders each having a plurality of holes; a deflector positioned within the barrel, the deflector being movable between at least an open position in which the opening is opened, and a deflecting position in which the opening is substantially closed by the deflector; and an actuator operationally connected to one of the first or second cylinders and operationally associated with the deflector for moving the deflector and the one of the first or second cylinders between at least a first position in which the holes on the first and second cylinders are not aligned and the deflector is in the open position, and a second position in which the holes on the first and second cylinders are aligned and the deflector is in the deflecting position.

The present invention also provides for a blow dryer which comprises a body including a barrel, with the barrel comprising a plurality of holes around its circumference; and a deflector positioned substantially within the barrel, the deflector being movable between at least an open position in which the barrel opening is opened, and a deflecting position in which the barrel opening is substantially closed; and an actuator operationally associated with the deflector for moving the deflector between at least the open position and the deflecting position.

The present invention also provides for a blow dryer which comprises a body including a barrel, with the barrel defining first and second concentric cylinders each having a plurality of holes; a deflector positioned substantially within the barrel, the deflector being movable between at least an open position in which the opening is opened and a fully deflecting position in which the opening is substantially closed by the deflector; and an actuator operationally connected to one of the first or second cylinders and operationally associated with the deflector for moving the deflector and the one of the first or second cylinders between at least a first position in which the holes on the first and second cylinders are not aligned and the deflector is in the open position, and a second position in which the holes on the first and second cylinders are aligned and the deflector is in the fully deflecting position.

The present invention also provides for a blow dryer which comprises a body including a barrel, with the body comprising a plurality of holes around its circumference; a deflector position substantially within the barrel, the deflector being movable between an open position in which the barrel opening is opened, at least one intermediate deflecting position in which the opening is partially closed, and a fully deflecting position in which the barrel opening is substantially closed; and an actuator operationally associated with the deflector for moving the deflector between the open position, the at least one intermediate deflecting position and the fully deflecting position.

The present invention also provides for a blow dryer which comprises a body including a barrel, with the barrel defining first and second concentric cylinders each having a plurality of holes; a deflector position substantially within the barrel, the deflector being movable between at least an open position in which the opening is open, at least one intermediate deflecting position in which the opening is partially closed by the deflector and a fully deflecting position in which the opening is substantially closed by the deflector; and an actuator operationally connected to one of the first or second cylinders and operationally associated with the deflector for moving the deflector and the one of the first or second cylinders between at least a first position in which the holes on the first and second cylinders are not aligned and the deflector is in the open position, at least one intermediate second position in which the holes on the first and second cylinders are partially aligned and the deflector is in the intermediate deflecting position, and a third position in which the holes on the first and second cylinders are fully aligned and the deflector is in the fully deflecting position.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 is a view of the blow dryer and barrel assembly of the present invention in a first position in which the holes of the inner and outer cylinders of the barrel are not aligned;

FIG. 2 is a front view of the barrel opening of the blow dryer of FIG. 1 in the first position showing the flaps or deflecting means in an opened position;

FIG. 3 is a view of the inner and outer cylinders of the barrel of the blow dryer in a second position in which the holes of the inner and outer cylinders are aligned;

FIG. 4 is a front view of the barrel opening when the inner and outer cylinders are aligned as shown in FIG. 3, in which the flaps or deflecting means substantially close the barrel opening;

DESCRIPTION OF THE PREFERRED EMBODIMENTS

Figures 5, 6, 7, 8:
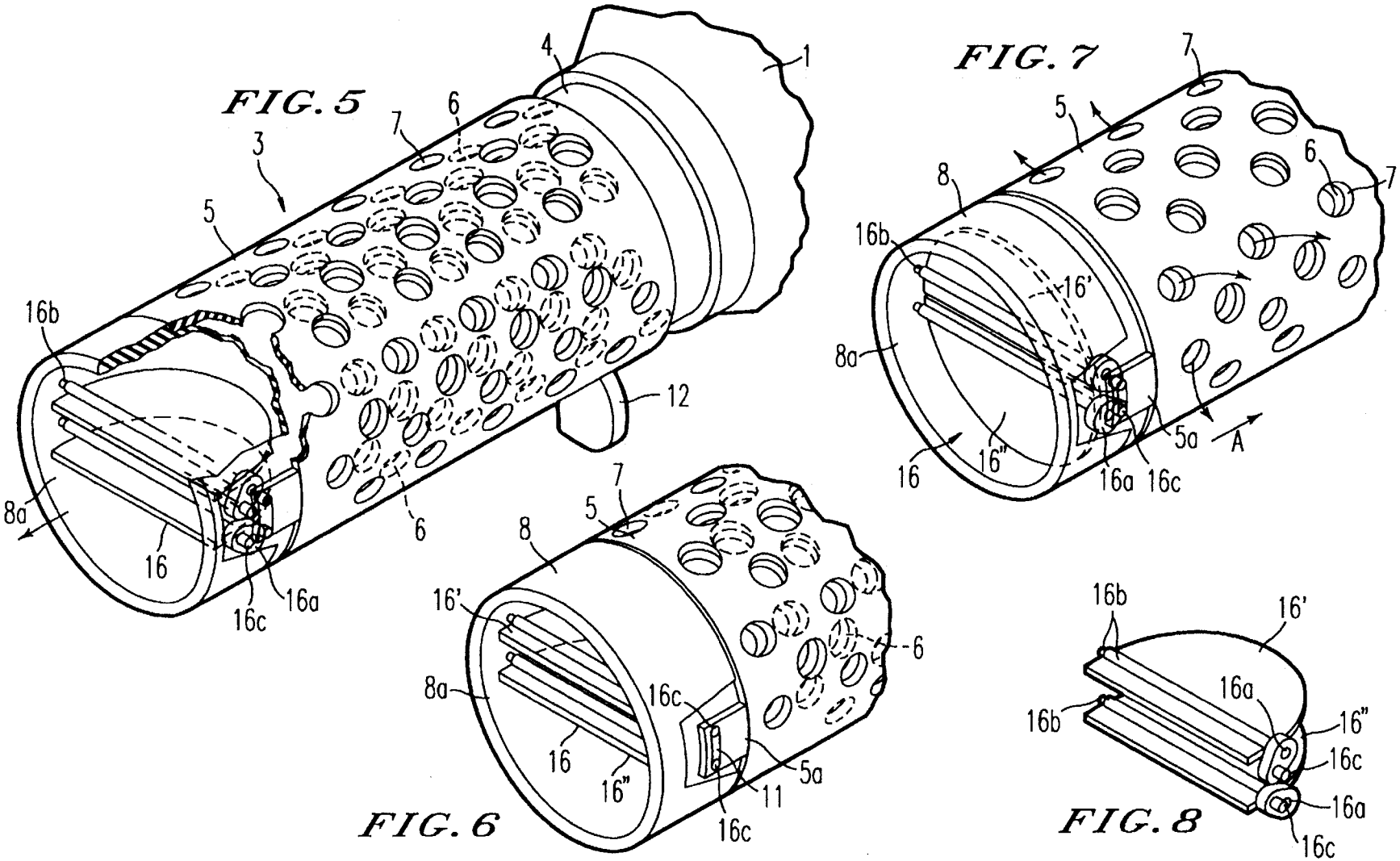
FIG. 5 is a perspective view of the inner and outer cylinders of the barrel and the flaps or deflecting means in the first position of FIGS. 1 and 2.
FIG. 6 is a perspective view of the flaps in an opened position as illustrated in FIG. 5.
FIG. 7 is a perspective view of the flaps and the inner and outer cylinders in the second position Of FIGS. 3 and 4.
FIG. 8 shows the flaps in isolation.

Referring now to the drawings, wherein like reference numerals designate identical or corresponding parts throughout the several views, and more particularly to FIGS. 1 and 5 thereof, FIG. 1 is a first view of the blow dryer assembly of the present invention while FIG. 5 is a perspective view. In FIGS. 1 and 5, the blow dryer includes a body 1 having a barrel 3. The barrel 3 can include an inner cylinder 4 and an outer cylinder 5 concentric with the inner cylinder 4. The outer cylinder 5 is slidably mounted on the inner cylinder 4. Each of the inner and outer cylinders (4, 5) includes a plurality of holes (6, 7) thereon (holes 6 on inner cylinder 4 and holes 7 on outer cylinder 5).

As further illustrated in FIGS. 1 and 6, the blow dryer assembly can also include a cap 8 which covers a pivotable flap mechanism 16. The cap 8 and pivotable flap mechanism 16 are positioned at the barrel opening 8*a*. The cap 8 in FIG. 6 shows a cut-out opening, however, it is recognized that the cap 8 can completely cover all the moving mechanisms including the pivotable flap mechanism 16 at the front of the barrel. Applicant notes, however, that the present invention can be used without the cap 8 and the use of the cap 8 depends on design considerations.

FIGS. 1, 5 and 6 illustrate a first position of the outer cylinder 5 with respect to inner cylinder 4 in which the holes 7 on the outer cylinder 5 are not aligned with the holes 6 of the inner cylinder 4 and the pivotable flap mechanism 16 is in an opened position. Therefore, any air flow through the barrel 3 will flow out of the barrel opening 8*a*. The non-aligned holes 6 and 7 of the inner and outer cylinders 4, 5 will block any air flow through the surface of the barrel 3.

In the position illustrated in FIGS. 3 and 7 the inner and outer cylinders 4, 5 are aligned so as to align the respective holes 6, 7 of the inner and outer cylinders 4, 5. In the position illustrated in FIGS. 3 and 7, the flap mechanism 16 is positioned as illustrated in FIGS. 4 and 7. That is, the flap mechanism 16 is positioned so as to substantially cover the barrel opening 8*a* as illustrated in FIGS. 4 and 7.

Figure 28:
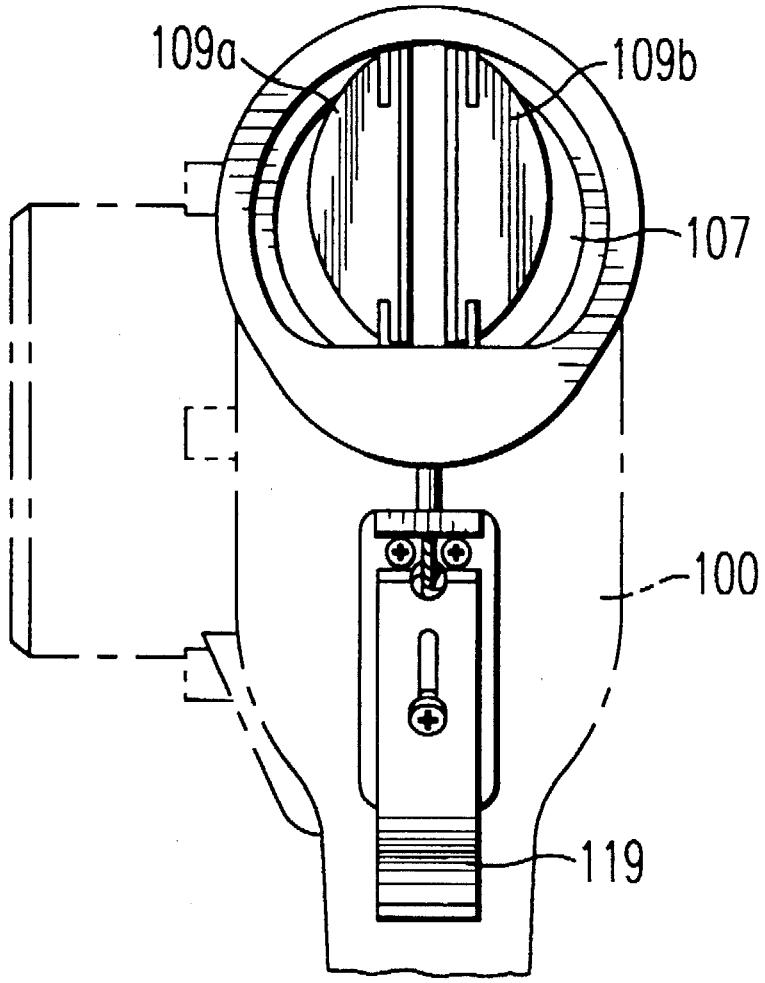
FIG. 28 is a front view of the barrel based on FIGS. 19 and 20.

It is noted that the movement of the inner and outer cylinders 4, 5 with respect to each other is coordinated with the movement of the flap mechanism 16 so as to achieve the positioning of the flap mechanism 16 as noted above. In this position (i.e., FIG. 7), the flap mechanism 16 will deflect most of the air flow so as to direct air flow to the aligned holes 6 and 7 of the inner and outer cylinders 4, 5. Thus, air will be discharged through the surface of the barrel 3. Therefore, by actuation of an actuator 12, a user can gradually, controllably or continuously cause the flap mechanism 16 to move from an open position to a substantially closed position illustrated in, for example, FIG. 7. As a further option, by actuation of the actuator 12, the user can gradually, controllably or continuously cause the flap mechanism 16 to move from the open position, to one or a plurality of intermediate deflecting positions (an example of an intermediate deflecting position is shown in FIGS. 26 and 28) which permit a desired partial closing of the barrel opening 8*a*, to the final substantially closed position illustrated in, for example, FIG. 7.

In coordination with the moving of the actuator the outer cylinder 5 can move in the direction A to cause the holes 6, 7 of the inner and outer cylinders 4, 5 to go from the fully non-aligned position of FIG. 5, to a final position in which the holes 6, 7 become fully aligned with each other as illustrated in, for example, FIG. 7. As a further option, between the fully non-aligned position (FIG. 5) and the fully aligned position (FIG. 7), in coordination with the movement of the actuator, the outer cylinder 5 can be moved to one or a plurality of intermediate positions in which the holes 6, 7 are partially misaligned (see FIG. 26).

The actuator 12 can be continuously movable so as to be controllable by the user, or one or a plurality of stops for the actuator which correspond(s) to the above noted positions can be provided.

Figure 26:
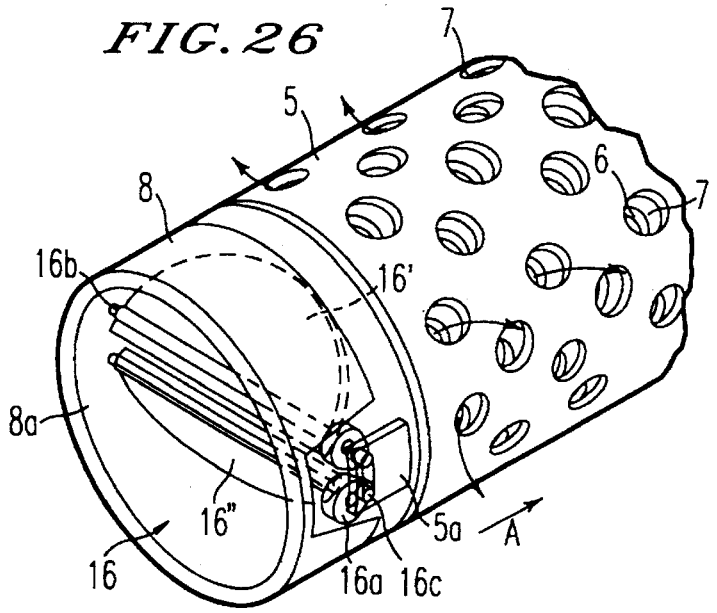
FIG. 26 is a further view of the barrel of the first embodiment.

Also, FIG. 26 shows the upper flap 16' moving in a counter clockwise direction and the lower flap 16" moving in a clockwise direction. It is noted that the rotational movement of the flaps is not limited to the disclosed movements. It is recognized that based on the position of the flap mechanism 16 within barrel 3, the flaps can move either clockwise or counter-clockwise to achieve the desired opening and closing of the barrel opening. The same applies to FIG. 28 which shows an example of an intermediate position of the deflector 109. It is therefore recognized that the direction of rotation of the deflector is based on design considerations.

As a further embodiment, Applicant notes that actuation of the actuator 12 can first cause a movement of one of the outer or inner cylinders 5, 4, and thereafter a delayed movement of the flap mechanism 16 to the substantially closed position. This approach will permit some diffused air to escape through the barrel opening.

An example of a mechanism for achieving the above-noted movement of the inner and outer cylinders 4, 5 and the flap mechanism 16 will now be described. As illustrated in FIGS. 5–8, as well as FIGS. 9(*b*) and 11(*a*)–11(*c*), the pivotable flap mechanism 16 includes first and second flaps 16', 16" having mounting axles 16*b* and mounting pins 16*c* extending therefrom. The mounting pins 16*c* are mounted in an offset manner on an oval activator 16*a* as illustrated in FIG. 8. The present invention can also utilize washers 16*d* (FIGS. (9) and 11(*a*)–11(*c*)) at the mounting pins 16*c* to permit a smooth operation. The pivotable flap mechanism 16 with the mounting pins 16*c* are mounted within the barrel 3, substantially within the barrel 3, or at the barrel opening 8(*a*) as follows: the mounting axles 16*b* and pins 16*c* are mounted so as to be inserted into elongated slots 17 on the inner cylinder 4 and elongated slot 11 on the outer cylinder 5 (see FIG. 6, FIG. 9(*a*) and FIG. 10). The slot 11 on the outer cylinder 5 is positioned on a protruding portion 5*a* of the outer cylinder 5. Thus, a movement of the outer cylinder 5 in the direction of the arrow A (FIGS. 1 and 7) will cause a movement of the pivotable flap mechanism 16 from at least the position illustrated in FIG. 5 in which the barrel opening 8*a* is opened, to a position illustrated in FIG. 7 in which the barrel opening 8*a* is substantially closed. This is due to the fact that the movement of the outer cylinder 5 in the direction A will cause the pins 16*c* of the pivotable flap mechanism 16 to rotate with the oval actuator 16*a*, which will thereby cause the pivotable flap mechanism 16 to rotate to the substantially closed position.

Figure 10:
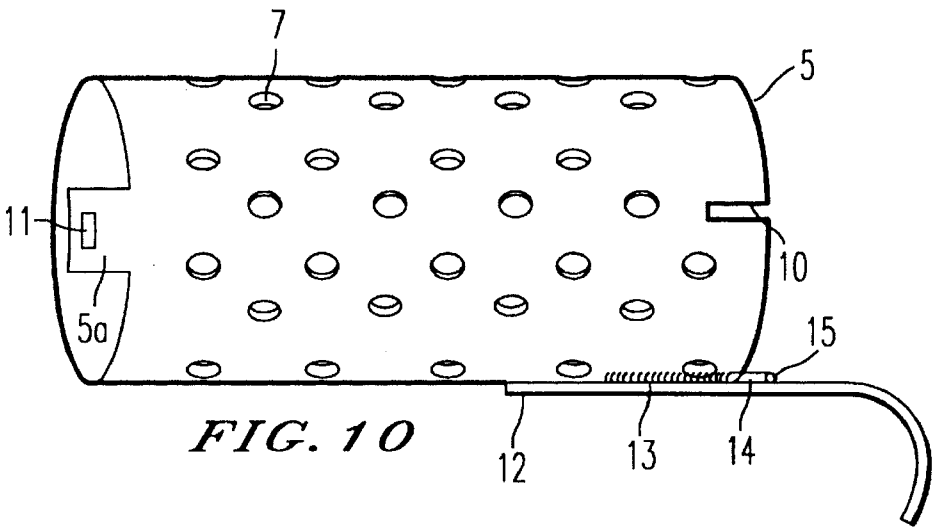
FIG. 10 shows the outer cylinder of the present invention.

The outer cylinder 5 can include the actuator such as, for example, the trigger 12 which is utilized to cause the sliding movement of the outer cylinder 5 with respect to the inner cylinder 4. The actuator or trigger 12 includes a spring 13 positioned in a slot 15 in the outer cylinder 5 which is guided by a pin 14 (FIGS. 1, 3, 10). The spring 13 urges the outer cylinder 5 in a direction opposite to direction A. Actuation of the actuator, such as, for example, pulling the trigger 12 in the direction A will cause the outer cylinder 5 to move in direction A which thereby causes the movement of the pivotable flap mechanism 16 from at least the position illustrated in FIG. 5 to the substantially closed position illustrated in FIG. 7. FIGS. 1, 3 and 10 show a single spring 13 positioned on a lower portion of the barrel assembly 3. It is noted, however, that the barrel assembly can also include two springs 13 positioned on diametrically opposed portions of the barrel assembly 3 to add stability to movement of the cylinders (4, 5).

At the same time or approximately at the same time, movement of the outer cylinder 5 in the direction A will also cause the holes 6, 7 of the inner and outer cylinders 4, 5 to become aligned with each other as illustrated in FIG. 7.

Therefore, in a first position (first mode) illustrated in FIGS. 1 and 5, the pivotable flap mechanism 16 is in the position illustrated in FIG. 5 to permit airflow through the barrel opening 8*a* and the hole on the inner and outer cylinders 4, 5 are not aligned (FIGS. 1 and 5) so as to block airflow through the surface of the barrel 3. This permits the user to use the blow dryer in a normal manner.

When the hair dresser desires to utilize the blow dryer for horizontal lifting/drying, styling, as a hot roller, as a diffuser, etc., the hair dresser actuates the actuator, for example, pulls the trigger 12 in the direction A to position the outer cylinder 5 with respect to inner cylinder 4 in the manner illustrated in FIGS. 3 and 7 (second or final mode). This will cause the holes 6, 7 on the inner and outer cylinders 4, 5 to become aligned, and will cause the flaps 16', 16" of the flap mechanism 16 to gradually pivot to the position illustrated in FIG. 7 to substantially close the barrel opening 8*a*. In this position, the flaps 16', 16" will deflect air towards the aligned holes 6, 7 exposed on the barrel, and some diffused air will flow through the barrel opening 8*a*. In a further feature of the present invention, the user can move the actuator 12 to intermediate positions which causes the flap mechanism 16 to controllably move through intermediate deflecting positions (one is shown in FIG. 26), and also causes the movement of one of the inner or outer cylinders 4, 5 to intermediate positions in which the holes 6, 7 are partially aligned (FIG. 26) so that a partial deflection will cause a desired air flow through the partially aligned holes 6, 7. Therefore, the use of intermediate positions of the actuator 12 can permit the user to finely control the amount of deflection by the flap mechanism 16 as well as the aligning positioning of the holes 6, 7.

It is recognized that the present invention is not limited to described arrangement for movement of the flap mechanism and cylinders, and any device such as, for example, gears which can achieve the desired movements noted above can be utilized.

Figure 9A:
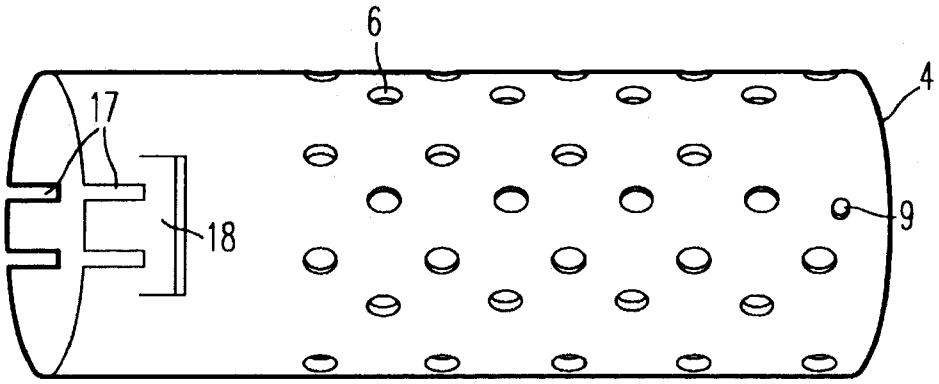
FIGS. 9(*a*), 9(*b*) and 9(*c*) respectively show the inner cylinder, flaps, and a cover for the barrel.
Figure 9B:
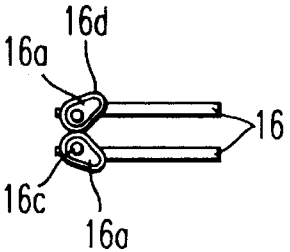
Figure 9C:
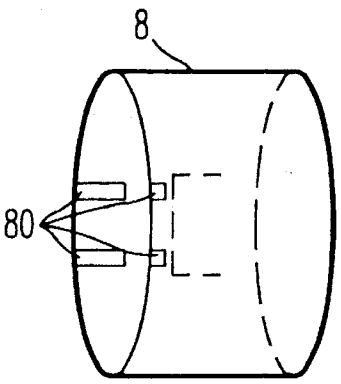
Figure 11A:
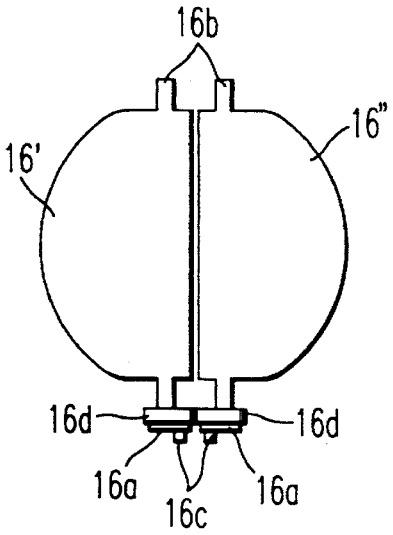
FIGS. 11(*a*), 11(*b*) and 11(*c*) show different views of the flaps.
Figure 11B:
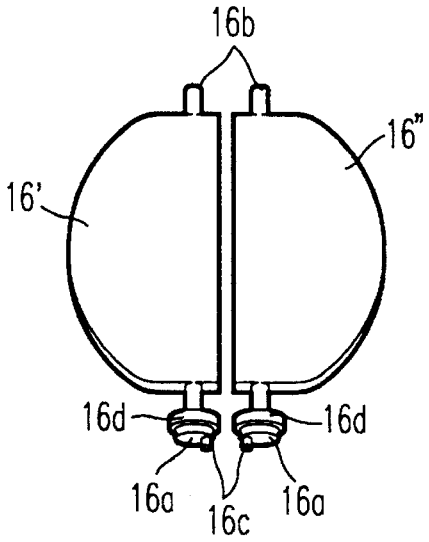
Figure 11C:
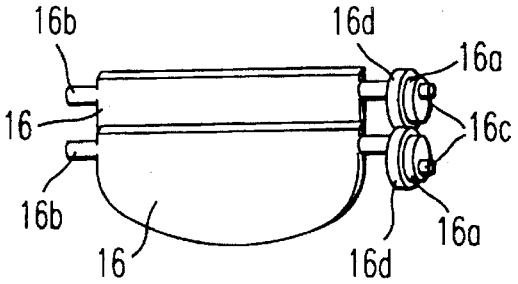

The amount of movement of the outer cylinder 5 with respect to the inner cylinder 4 can be determined by providing for an elongated slot 10 on the outer cylinder 5 and a pin 9 on the inner cylinder 4 as illustrated in FIGS. 1, 3, 9(*a*) and 10. When the barrel opening 8*a* is substantially closed by the flaps 16', 16" as illustrated in FIG. 7, the barrel opening 8*a* is not sealed tightly by the flaps 16', 16" so as to permit some air to be diffused from the barrel opening.

The present invention can also provide for the cap 8 illustrated in FIGS. 6 and 9(*c*) which can be utilized to cover the flap mechanism 16. The cap 8 shows a cut-away portion to illustrate the side of the flap mechanism 16. It is recognized that the cap 8 can completely surround the circumferential front of the barrel. The cap 8 also can include stops 80 (FIG. 9(*c*)) such that the cap 8 fits over the outer cylinder 5 and includes cooperating holes which permit the insertion of the axles 16*b* and pins 16*c* of the flap mechanism 16.

Figure 12:
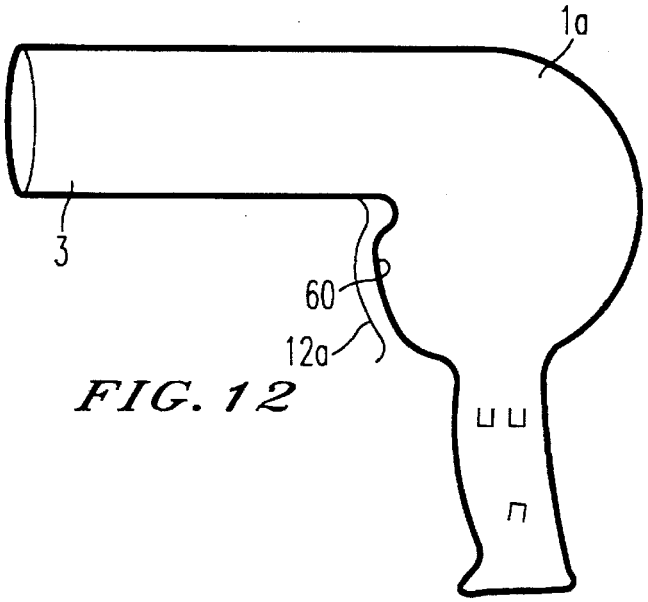
FIG. 12 shows a different blow dryer body embodiment.

The blow dryer arrangement of the present invention can also be utilized on a blow dryer la having a belly type curve 60 in the motor housing as illustrated in FIG. 12 or any other type of body. In the case of a belly type body, the actuator or trigger 12*a* would have a curve which matches the curve of the housing. This embodiment would operate in the same manner as the embodiment discussed above.

Additionally, the actuator or trigger 12 of the present invention can be operationally associated with a control mechanism 50 (FIG. 13) which coordinates the actuation of the trigger 12 with temperature settings of a blow dryer. For example, a conventional blow dryer can include low, medium and high settings. The trigger mechanism 12 of the present invention can be operationally associated with a control mechanism 50 such as illustrated in FIG. 13 to lower a high temperature setting of a blow dryer to a temperature setting which is lower than the high temperature setting when the trigger 12 is actuated.

Figure 13:
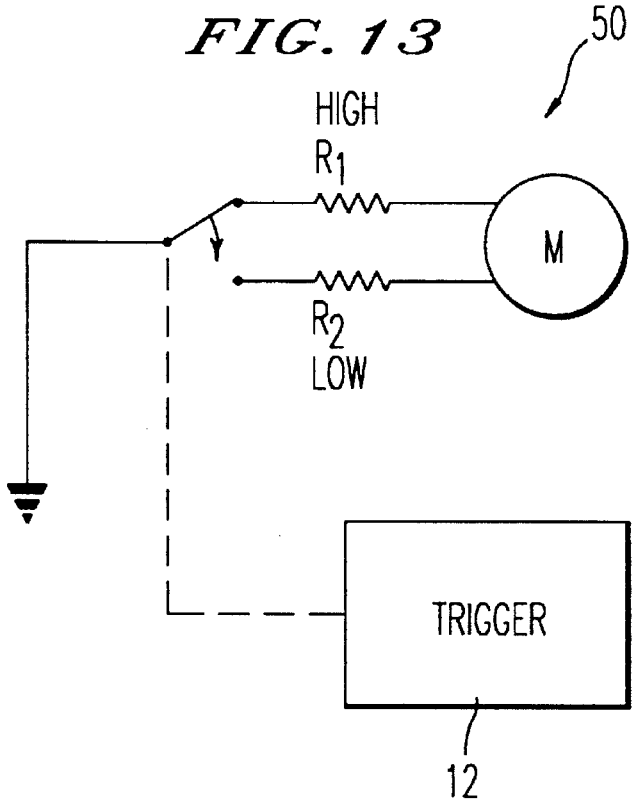
FIG. 13 shows a circuit arrangement for controlling temperature settings for the blow dryer of the present invention.

As illustrated in FIG. 13, the positioning of the actuator or trigger 12 in the first position (FIGS. 1 and 5) in which the holes 6, 7 are not aligned and the air flow is through the front opening 8*a* of the barrel can permit the hair dryer setting to be set at the high temperature setting ($R_1$) of a blow dryer. Movement of the actuator or trigger 12 to the second or final position (FIGS. 3 and 7) in which the holes 6, 7 are aligned and the front opening 8*a* is substantially closed, can cause the dryer setting to be positioned in a temperature setting ($R_2$) which is lower than the high temperature setting of a blow dryer. The explanation given above has been given for the situation when the blow dryer is in the high temperature setting when the actuator or trigger is fully actuated. It is recognized that the control mechanism 50 can be designed so as to not lower the temperature if upon the actuation of the trigger 12, the blow dryer is set at the medium or low temperature settings. However, the lowering of the temperature setting of the blow dryer when the trigger 12 is actuated, is based on design considerations and the desired temperature which would be preferable when the actuator or trigger 12 is actuated. It is further recognized that the blow dryer could include an additional actuator or trigger mechanism which is not associated with the actuation of the actuator or trigger 12 so as to permit the user to selectively lower the temperature from a high temperature to a temperature lower than the high temperature.

Figure 14:
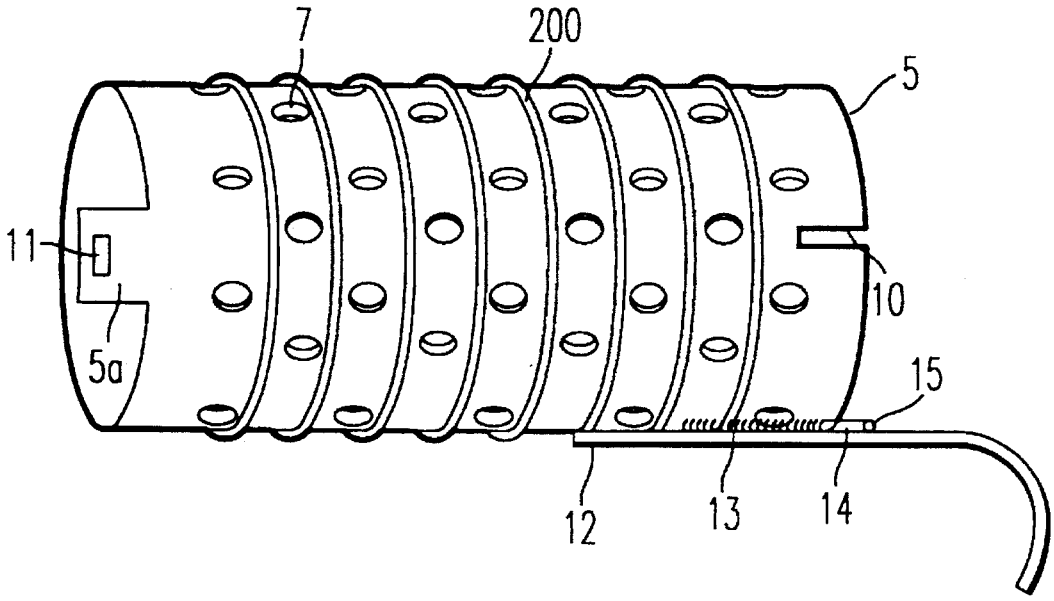
FIG. 14 shows a modification of the outer cylinder of the present invention.

FIG. 14 shows a further embodiment of the outer cylinder 5 of the barrel 3 in which the outer cylinder 5 includes rings 200 that are spaced along the length of the outer cylinder 5, are affixed to the periphery of the outer cylinder 5 and extend around the circumference of the outer cylinder 5. The rings 200 serve to guide hair when the barrel assembly is positioned against hair. The rings 200 are aligned so as to not obstruct air flow from the holes (6, 7). These rings 200 can be utilized on any of the disclosed embodiments.

Figure 15:
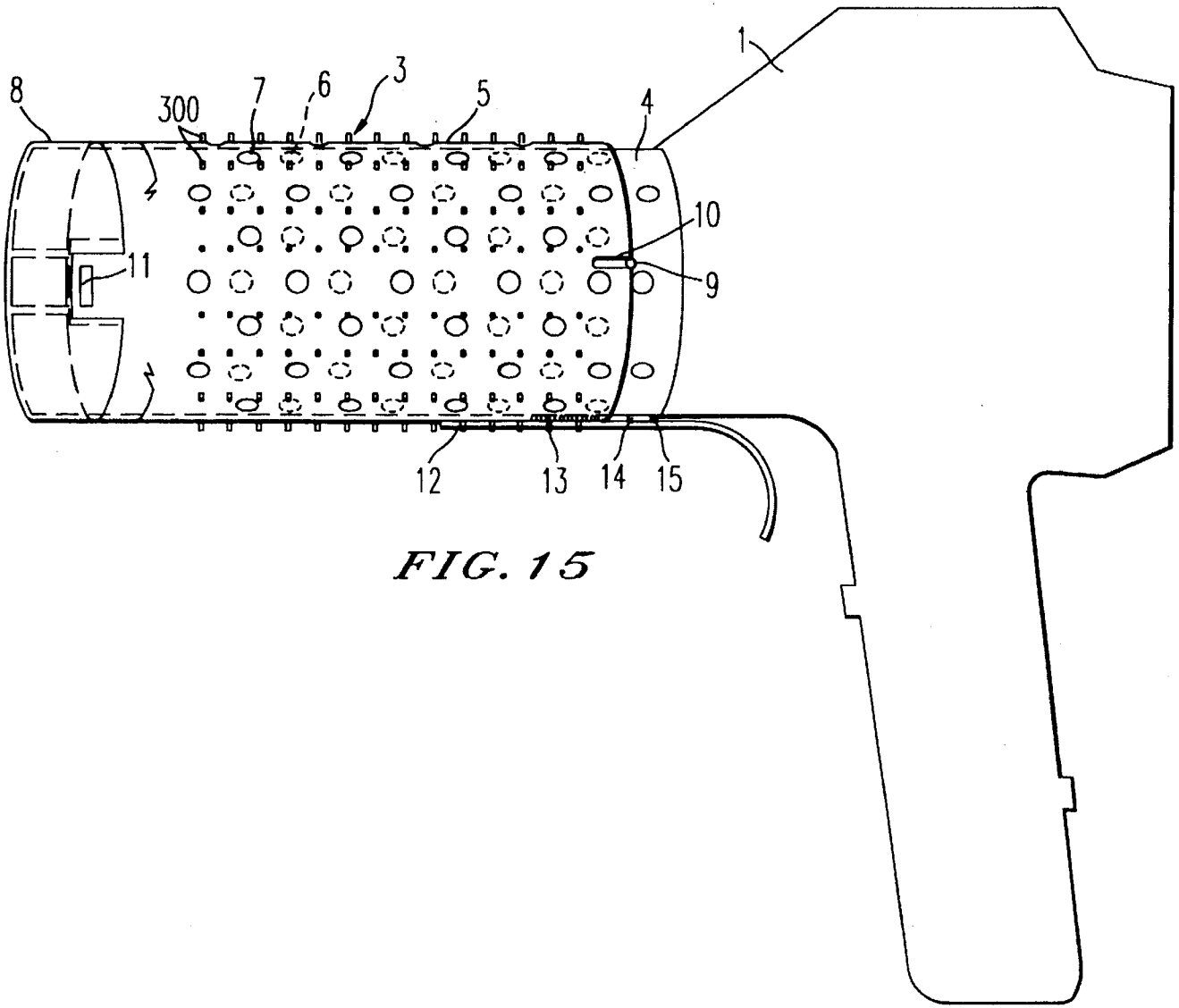
FIG. 15 shows a further modification of the blow dryer of the present invention.

FIG. 15 shows a further embodiment of the barrel 3 in which the outer cylinder 5 of the barrel 3 can include projections such as bristles or teeth 300 spaced between the holes 7 of the barrel as illustrated in the figure, so as to extend in a row between the holes 7. The bristles or teeth 300 can extend around the periphery of the outer cylinder 5 of the barrel 3 and can be utilized to guide hair and for further styling enhancement. These projections 300 like the rings 200 can be utilized on any of the disclosed embodiments.

Figure 16:
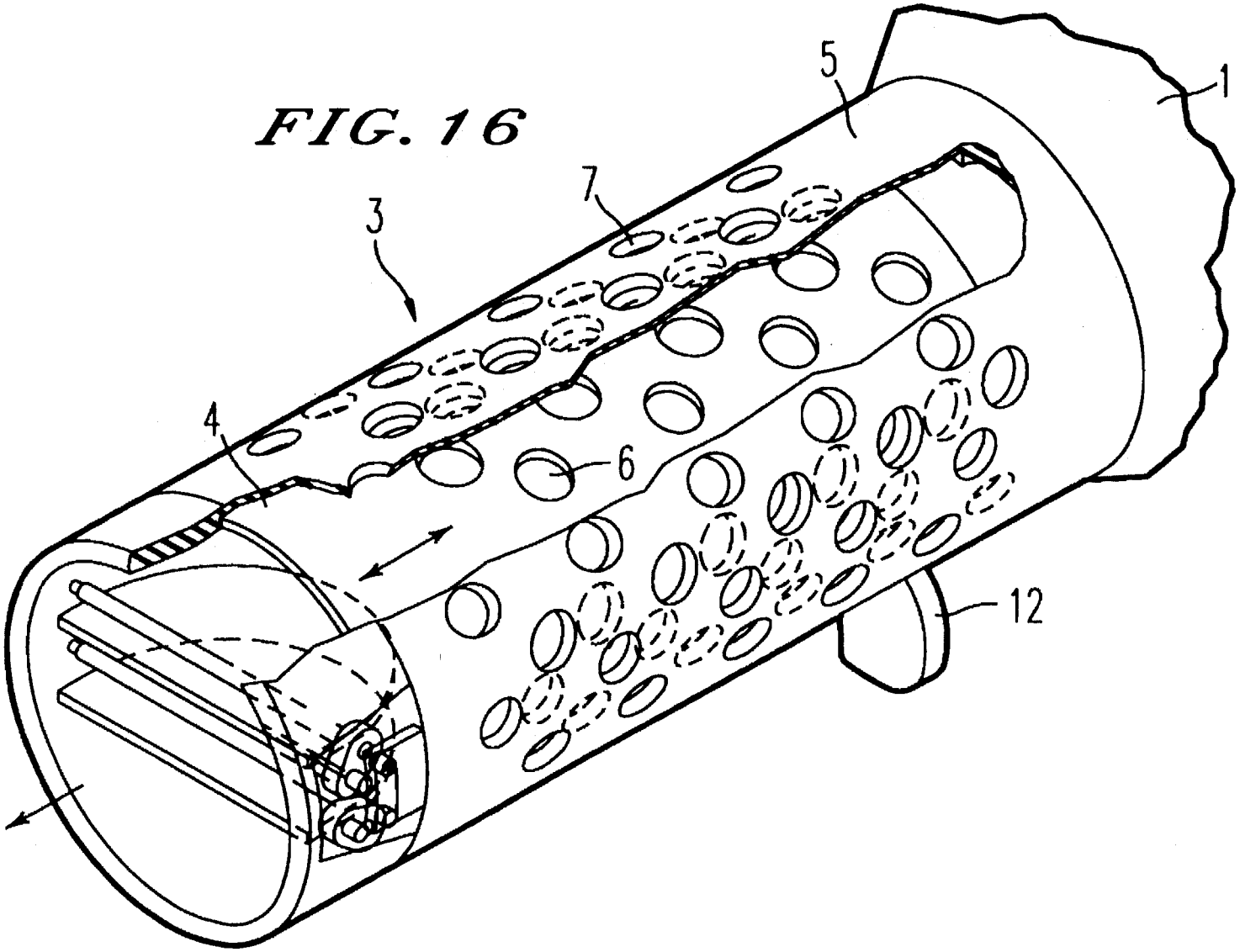
FIG. 16 is a further modification of the barrel of the blow dryer of the present invention.

FIG. 1 shows the actuator being operationally connected to the outer cylinder of the barrel such that the outer cylinder is slidable with respect to the inner cylinder. However, the invention is not limited to this arrangement and Applicant notes that as a further embodiment, the inner cylinder 4 can slidably move within the outer cylinder 5 (FIG. 16). In this embodiment, the outer cylinder 5 would be fixed or integral to the body 1. With this arrangement, the inner cylinder 4 can be operationally connected to the actuator 12 so as to be slidable with respect to the outer cylinder 5. With respect to the remaining features of the invention, this arrangement would work in a similar manner as described above with respect to the first embodiment.

Figure 17:
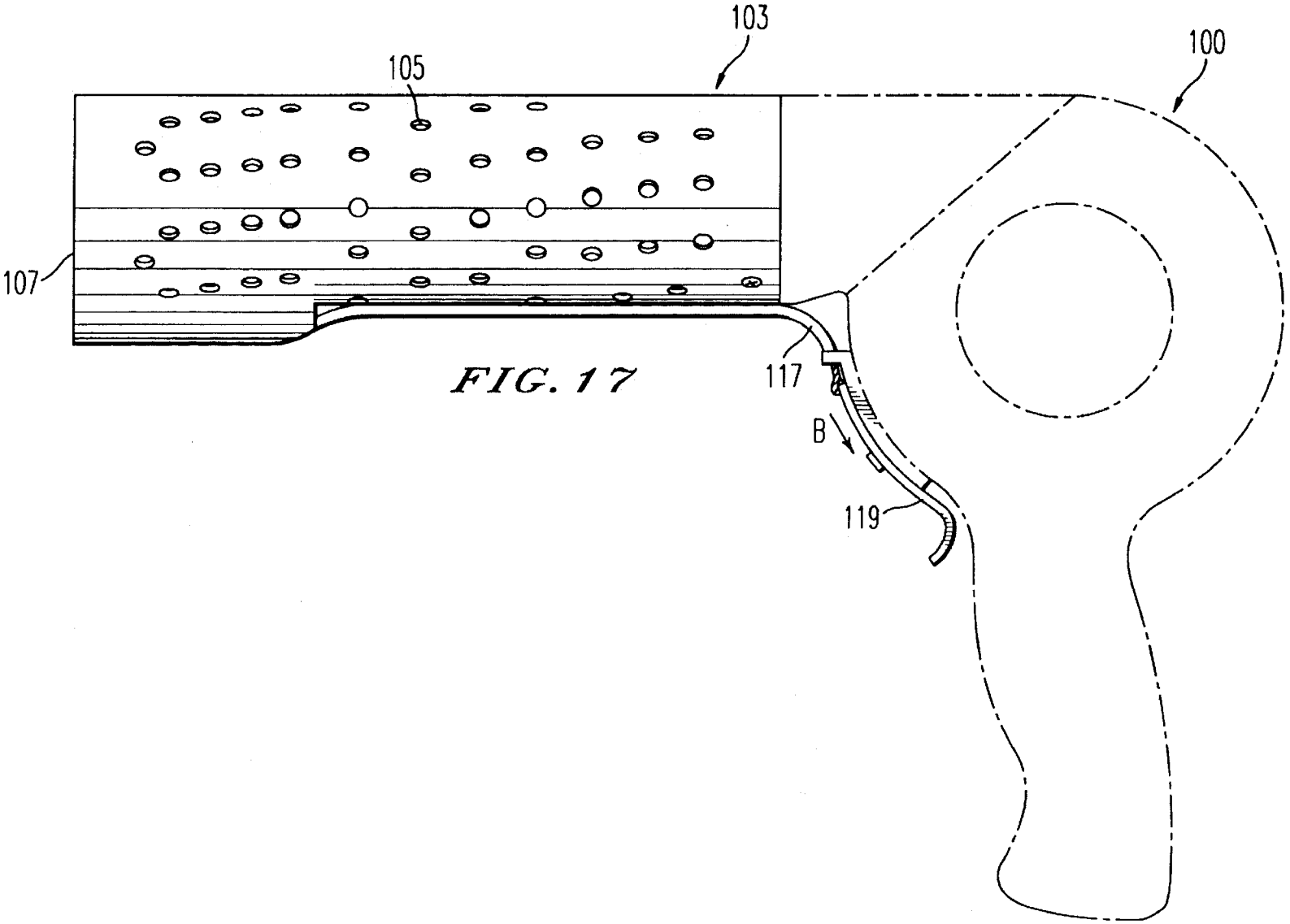
FIG. 17 shows a further embodiment of the blow dryer of the present invention in which the body of the blow dryer includes a barrel with a plurality of holes and deflector.
Figures 18, 19, 20:
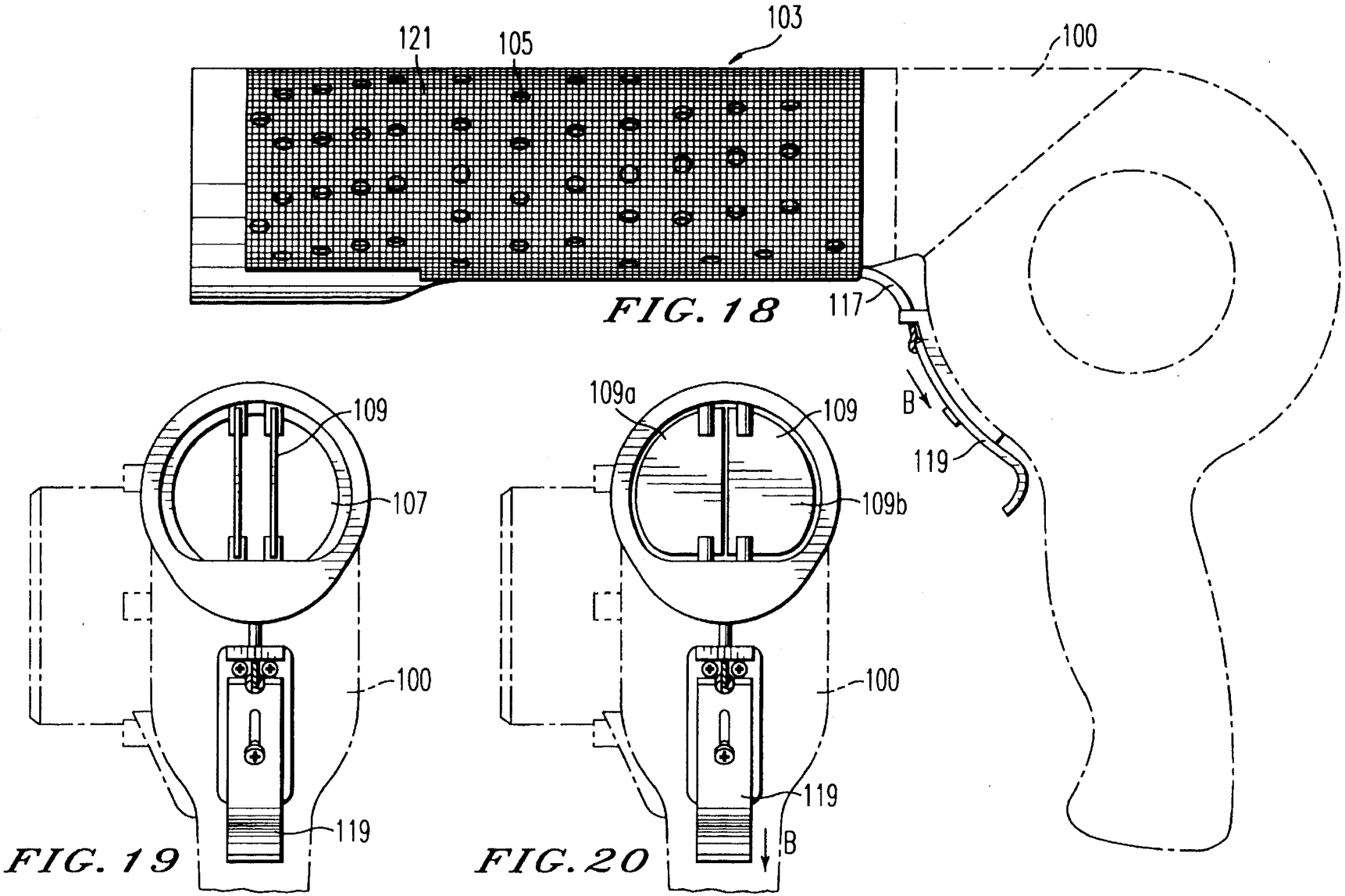
FIG. 18 illustrates a further variation of the blow dryer of FIG. 17 in which the blow dryer includes a mesh-type screen surrounding the barrel.
FIG. 19 is a front view of the blow dryer of the present invention in which deflector is in an open position.
FIG. 20 is a front view of the blow dryer of the present invention in which the deflector is in a final closed position.

FIG. 17 illustrates a further embodiment of the blow dryer of the present invention. In FIG. 17, the body 100 can be similar to the body 1 illustrated in the previous embodiments. The embodiment of FIG. 17 includes a barrel 103 which is fixed or integral to the body 100 and has a plurality of holes 105. A deflector 109 can be positioned within the barrel 103 or substantially within the barrel 103. As an example, the deflector 109 can be positioned at an opening 107 of the barrel 103, as illustrated in FIGS. 19 and 20. The deflector 109 can be arranged as illustrated in the previous embodiments or can be a vertically arranged deflector as illustrated in FIGS. 19 and 20. Applicant notes, however, that the orientation of the deflector 109 is not limited to the horizontal or vertical arrangements shown, and can be oriented in any manner within the barrel 103.

Figure 25A:
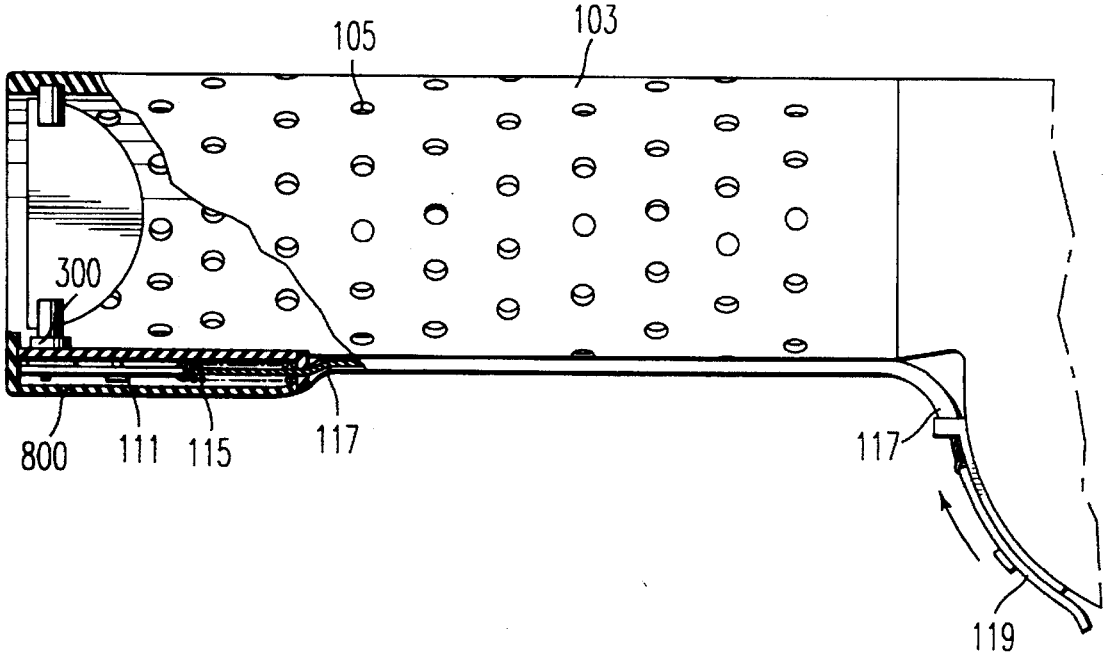
FIGS. 25(*a*) and 25(*b*) are side views of an embodiment of the blow dryer of the present invention illustrating a mechanism for actuating the deflector mechanism.
Figure 25B:
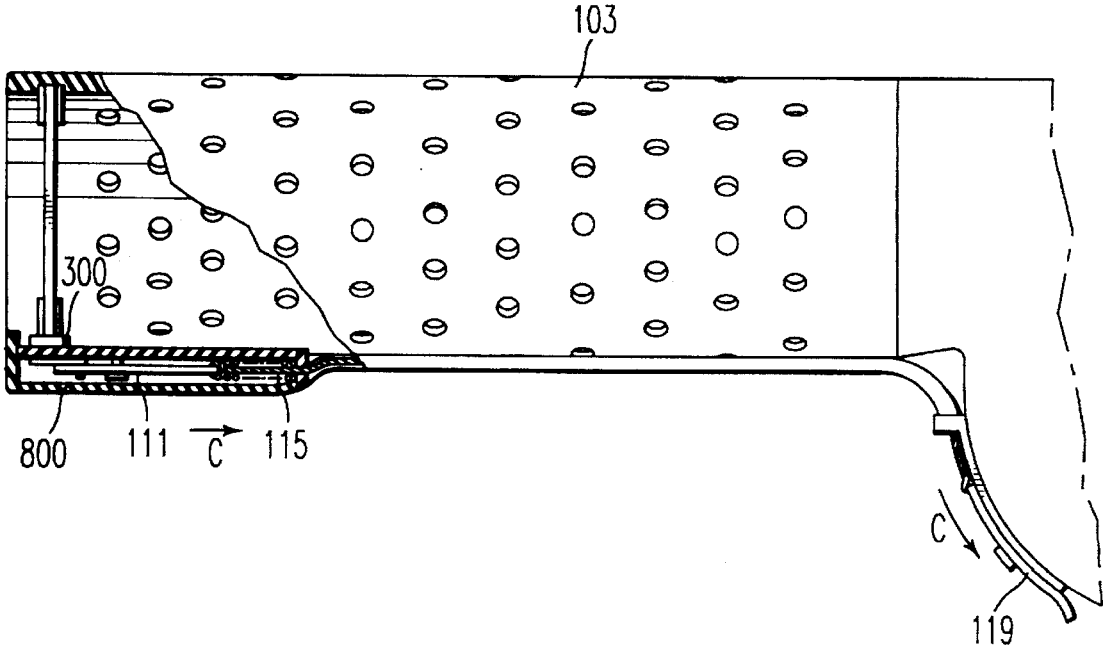
Figure 27:
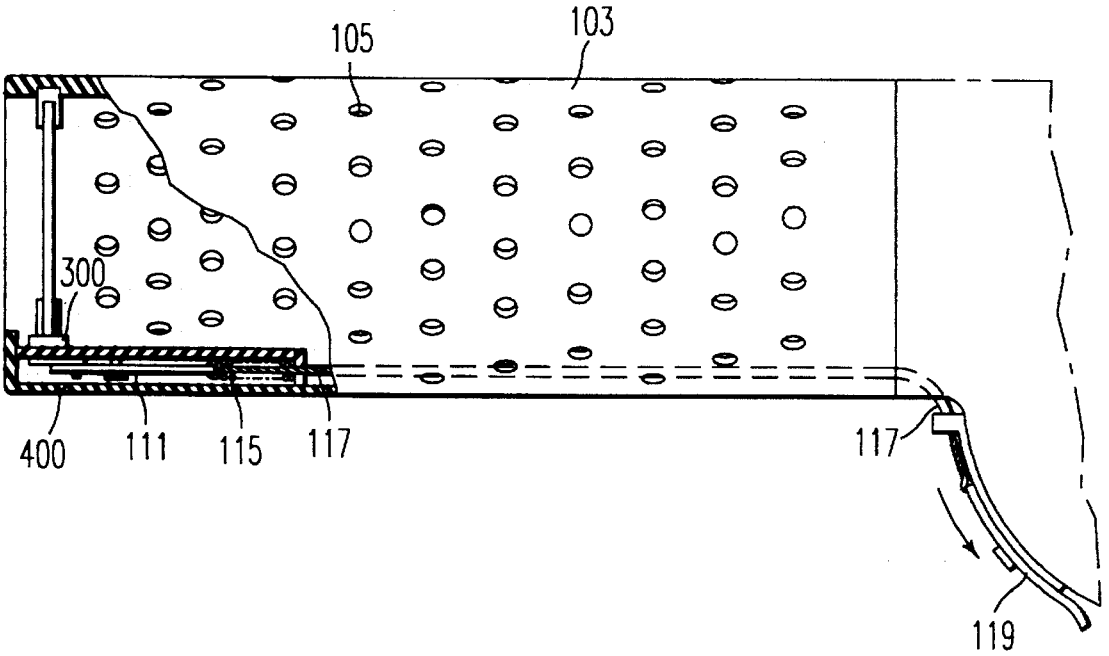
FIG. 27 is a side view illustrating a further variation of the barrel.

The deflector 109 of FIGS. 19 and 20 includes flaps 109*a*, 109*b*, and a plate member 111 and spring arrangement 115 (FIGS. 25(*a*), 25(*b*)) which maintains the deflector 109 in the open position illustrated in FIGS. 19 and 25(*a*). Attached to the plate member 111 is a connecting member 117 which extends along the barrel 103 to an actuator 119 on the barrel 103 or on the body 100. Although the figures show the connecting member 117 outside the barrel 103, as shown in FIG. 27, it is recognized that the connecting member 117 can be contained within the barrel 103.

Actuation of the actuator 119 in direction B causes the plate member 111 to move in direction C (FIG. 25(*b*)) to cause a gradual pivoting or rotation of the flaps 109*a*, 109*b* about pivot point 800. This causes a movement of the deflector mechanism 109 from at least the open position illustrated in FIGS. 19 and 25(*a*) to the substantially closed position of FIGS. 20 and 25(*b*). As previously explained, it is further recognized that the actuator 119 can be adapted so as to move the deflector 109 to different intermediate deflecting positions (one is shown in FIG. 28) between the open and substantially closed position depending on the desired air flow and design considerations.

Although the plate member 111 and spring arrangement 115 is shown in an expanded portion 400 of the barrel 103, this configuration is shown for illustrative purposes and clarity. It is recognized that the plate member 111, the spring 115 and the connecting member 117 can be arranged or contained within the barrel 103 so as to provide for a continuous and straight barrel as illustrated in FIGS. 1, 16 and 28.

With the embodiment illustrated in FIG. 17, during a normal blow drying operation, the deflector 109 is in the open position (FIG. 19) and air travels through the opening 107 of the barrel 103. The provision of the holes 105 along the barrel 103 permit some amount of air to flow through the holes 105, but not enough to disrupt the conventional or normal blow drying operation.

When the hair dresser desires to utilize the blow dryer for horizontal lifting/drying, styling, as a hot roller, as a diffuser, etc., the hair dresser actuates the actuator 119 in the direction B to gradually and substantially close the barrel opening 107 with the deflector 109. The deflector 109 will therefore deflect and ultimately force most of the air flowing through the barrel 103 out of the holes 105 on the barrel 103 so that the blow dryer can be utilized for horizontal lifting/drying, etc. As the deflector 109 is being actuated to the substantially closed position, depending on the preference of the user it can further variably deflect air in intermediate deflecting positions between the open position and the substantially closed position of the deflector. In this embodiment, the actuator 119 can be modified to provide for several stop positions which correspond to the intermediate positions of the deflector 109. However, the actuator 119 can also be freely and continuously movable to permit the user to control the amount of deflection.

Figure 23:
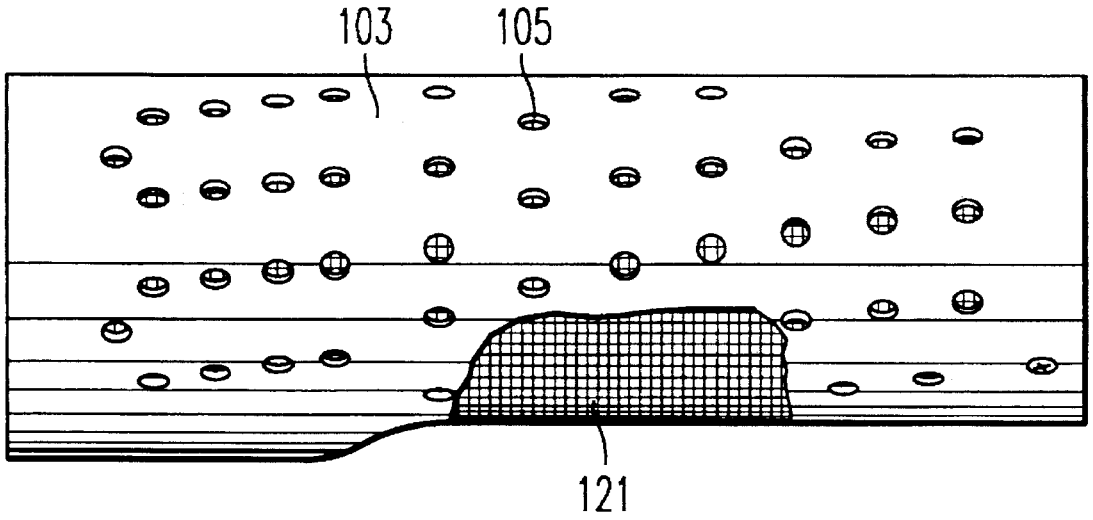
FIG. 23 shows a further variation of the barrel in which the mesh-type screen is positioned radially within the barrel.
Figure 24:
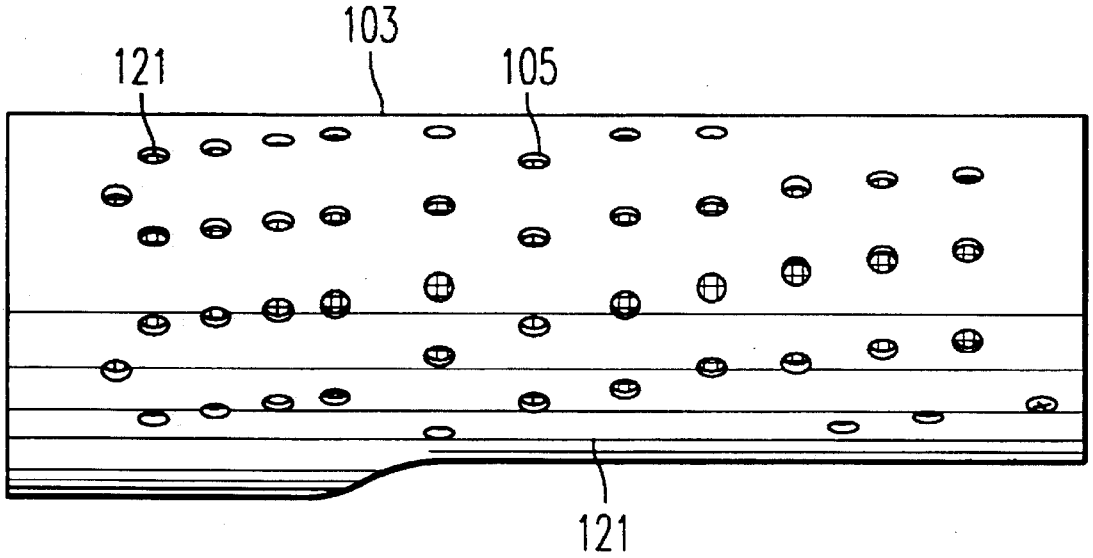
FIG. 24 is a further variation of the barrel of the present invention in which the holes of the barrel are integrated with a mesh-type screen within the holes.

Going back to FIG. 17, during the normal operation of the blow dryer in which the deflector 109 is in the open position (FIG. 19), if the user desires that less air escape through the holes 105 on the barrel 103, as a further embodiment of the invention, the barrel 103 can include a mesh-type screen 121 positioned cylindrically around the barrel 103 (FIG. 18). The mesh-type screen 121 serves to block or obstruct some air traveling through the holes 105 in the blow drying mode of FIG. 19. However, in the variably deflecting positions as well as the deflecting position of FIG. 20 in which the deflector 109 substantially closes the barrel opening 107, enough air will be forced through the holes 105 so as to permit horizontal lifting/drying, etc. The embodiment of the barrel 103 with the mesh-type screen 121 illustrated in FIG. 18 shows the mesh around the barrel 103. However, as a further option, the mesh-type screen 121 can be positioned cylindrically within the barrel 103 as illustrated in FIG. 23 or the mesh-type screen 121 can be integrated into the holes as illustrated in FIG. 24.

Figure 21:
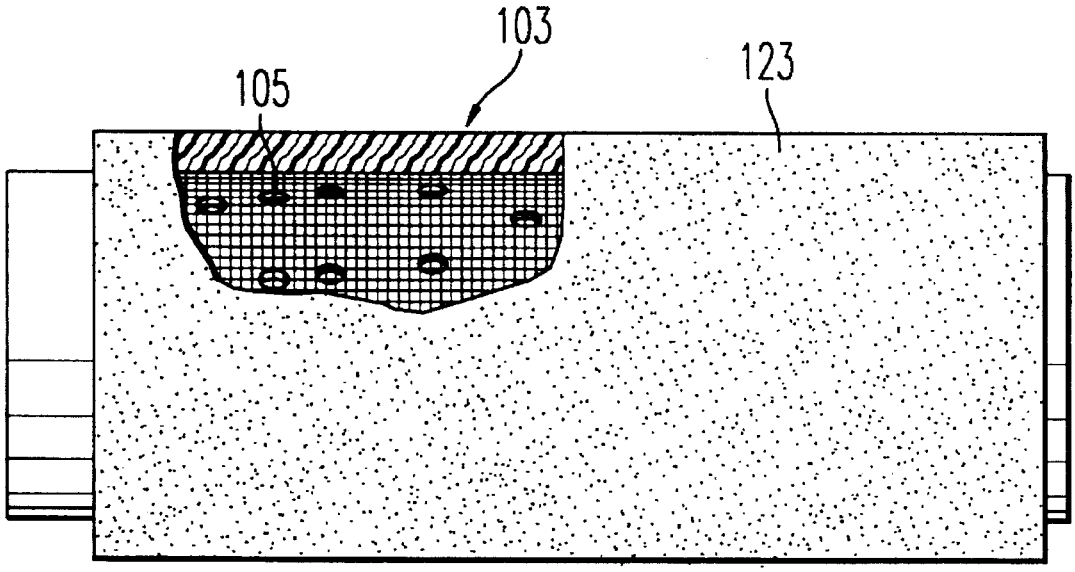
FIG. 21 is a further variation of the barrel of the blow dryer of FIG. 18 in which a foam-type mesh surrounds the barrel.

As a further option, the barrel can include a foam-type covering 123 over the mesh-type screen 121 or over the barrel 103 (FIG. 21) so as to further block or obstruct some air traveling through the holes 105 during the normal or conventional blow drying operation of FIG. 19. However, the foam-type covering 123 is porous to permit deflected air forced through the holes 105 when the deflector 109 is in intermediate deflecting positions between the open and substantially closed position or in the substantially closed position (FIG. 20) to escape from the barrel surface, so that the user can utilize the blow dryer for horizontal lifting/drying, etc.

The mesh-type screen 121 can be made of any type of material which is capable of withstanding the temperatures which are prevalent in blow drying operations and is bendable into a cylindrical configuration to match the barrel 103. For example, the mesh-type screen 121 can be a frame grid of wire netting. The foam-type arrangement 123 can also be made of any material which is able to withstand the temperatures of a blow drying operation and can be an elastic type member which can be easily slipped on or off of the barrel 103. The material of the mesh and foam arrangements is such that in the deflecting positions of the blow dryer (FIG. 20), air forced out through the holes 105 can pass through the materials for the use of the blow dryer for horizontal lifting/drying, etc.

Figure 22:
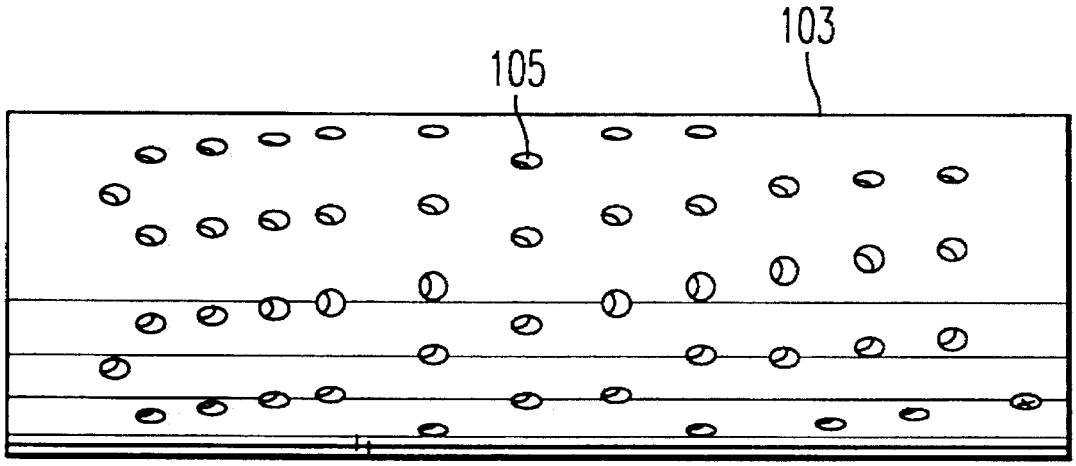
FIG. 22 shows a further variation of the barrel in which the plurality of holes on the barrel assembly are slanted.

As a further feature of the present invention the holes 105 on the barrel 103 can be slanted (FIG. 22) so as to provide for a variation in the direction of air in the deflecting position (FIG. 20), and also provide for a desired obstruction of air when the blow dryer is used in a normal operation (FIG. 19) in which the deflector 109 is open. Although FIG. 22 illustrates the holes 105 as slanted in one direction, it is recognized that the holes 105 can be slanted in various directions depending on design considerations.

Also, although the illustrated blow dryer of FIG. 17 shows a belly-type body, the actuator 119 can be positioned anywhere with respect to the blow dryer assembly depending on the type of barrel and blow dryer body utilized. The blow dryer of the above-noted embodiments can also use a control mechanism 50 as illustrated in FIG. 13. Additionally, the barrel of the blow dryer of these embodiments can include the modifications with respect to the rings 200 and the bristles or teeth 300 illustrated in FIGS. 14 and 15.

Thus, the blow dryer of the present invention maximizes the blow dryer's capability by incorporating multiple functions in one tool. It thereby provides a hair dresser or stylist with a wide range of airflow use by utilizing a single tool that is operated by one hand. That is, by simply actuating an actuator such as pulling on the trigger 12, the hair dresser can vary the air flow through the barrel. Any desired attachments can be fitted over the barrel of the present invention Just as with current blow dryers, and used whether or not the actuator is operated. The blow dryer of the present invention can also be used as a large hot roller, and it has some diffusing capabilities from the barrel opening when the actuator is operated and also from the entire barrel surface if the blow dryer motor speed is set lower.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A blow dryer comprising:

a body including a barrel having a barrel opening, said barrel comprising a plurality of holes which are disposed around a circumference of the barrel and are spaced along substantially an entire length of the barrel;

a deflector positioned substantially within said barrel, said deflector being movable between at least an open position in which said barrel opening is opened, and a deflecting position in which said barrel opening is substantially closed, wherein in the deflecting position an air flow through said barrel is substantially deflected by said deflector so as to pass through all of said holes, such that a positioning of a surface of the barrel adjacent to hair to be dried and/or styled directs air passing through said holes to the hair, thereby permitting the use of the barrel as a drying and/or styling tool by allowing air to be continuously directed to the hair through said holes; and an actuator operationally connected to said deflector for moving said deflector between at least said open position and said deflecting position.

2. A blow dryer according to claim 1, further comprising a mesh-type screen surrounding said barrel so as to partially obstruct an air flow through the plurality of holes.

3. A blow dryer according to claim 2, further comprising a removable foam-type material surrounding said mesh-type screen on said barrel so as to increase the obstruction of air flow through said plurality of holes.

4. A blow dryer according to claim 1, further comprising a removable foam-type material surrounding said barrel so as to partially obstruct an air flow through the plurality of holes.

5. A blow dryer according to claim 3, wherein said foam-type material is elastic.

6. A blow dryer according to claim 4, wherein said foam-type material is elastic.

7. A blow dryer according to claim 1, further comprising a mesh-type screen positioned cylindrically inside of said barrel so as to partially obstruct an air flow through said plurality of holes.

8. A blow dryer according to claim 1, further comprising a mesh-type screen integrated into each said plurality of holes so as to partially obstruct an air flow through said plurality of holes.

9. A blow dryer according to claim 1, wherein said deflector comprises first and second flaps movably mounted at said barrel opening.

10. A blow dryer according to claim 1, wherein said actuator is movably mounted on said body.

11. A blow dryer according to claim 10, further comprising a spring member on said barrel for urging said deflector to at least the open position, and a connector member extending between said spring member and said actuator, wherein a movement of said actuator causes a movement of said connector member to urge the deflector against the spring member and move the deflector to at least the substantially closed position.

12. A blow dryer according to claim 1, wherein said holes in said barrel are slanted.

13. A blow dryer comprising:

a body including a barrel having a barrel opening, said barrel comprising concentric inner and outer cylinders, each of said inner and outer cylinders having a plurality of holes; and an actuator operationally connected to one of said inner or outer cylinders for moving said one of said inner or outer cylinders with respect to the other of said inner or outer cylinders between at least a first position in which said holes on said inner and outer cylinders are not aligned and a second position in which said holes on said inner and outer cylinders are aligned.

14. A blow dryer comprising:

a body including a barrel with a plurality of first holes and a barrel opening;

a cylinder movably mounted on said barrel and having a plurality of second holes; and a deflector positioned within said barrel and movable between at least an open position in which said barrel opening is opened and a deflecting position in which said barrel opening is substantially closed.

15. A blow dryer comprising:

a body including a barrel having an opening, said barrel defining first and second concentric cylinders each having a plurality of holes;

a deflector positioned within said barrel, said deflector being movable between at least an open position in which the opening is opened, and a deflecting position in which the opening is substantially closed by the deflector; and an actuator operationally connected to one of said first or second cylinders and operationally associated with said deflector for moving the deflector and said one of said first or second cylinders between at least a first position in which said holes on the first and second cylinders are not aligned and the deflector is in the open position, and a second position in which said holes on the first and second cylinders are aligned and the deflector is in the deflecting position.

16. A blow dryer comprising:

a body including a barrel, said barrel defining first and second concentric cylinders each having a plurality of holes;

a deflector positioned substantially within said barrel, said deflector being movable between at least an open position in which the opening is opened, and a fully deflecting position in which the opening is substantially closed by the deflector; and an actuator operationally connected to one of said first or second cylinders and operationally associated with said deflector for moving the deflector and said one of said first or second cylinders between at least a first position in which said holes on the first and second cylinders are not aligned and the deflector is in the open position, and a second position in which said holes on the first and second cylinders are aligned and the deflector is in the deflecting position.

17. A blow dryer according to claim 14, wherein the cylinder includes projections which are spaced between the second holes.

18. A blow dryer according to claim 17, wherein said projections are bristles.

19. A blow dryer according to claim 17, wherein said projections are teeth.

20. A blow dryer comprising:

a body including a barrel having a barrel opening, said barrel comprising a plurality of holes around its circumference, said holes being spaced along substantially an entire length of the barrel;

a deflector positioned substantially within said barrel, said deflector being movable between an open position in which said barrel opening is opened, at least one intermediate deflecting position in which said opening is partially closed, and a fully deflecting position in which said barrel opening is substantially closed, wherein in said intermediate deflecting position and said fully deflecting position an air flow through said barrel is substantially deflected by said deflector so as to pass through all of said holes, such that a positioning of a surface of the barrel adjacent to hair to be dried and/or styled directs air passing through said holes to the hair, thereby permitting the use of the barrel as a drying and/or styling tool by allowing air to be continuously directed to the hair through said holes; and an actuator operationally associated with said deflector for moving said deflector between said open position, said at least one intermediate deflecting position and said fully deflecting position.

21. A blow dryer comprising:

a body including a barrel, said barrel defining first and second concentric cylinders each having a plurality of holes;

a deflector positioned substantially within said barrel, said deflector being movable between at least an open position in which the opening is opened, at least one intermediate deflecting position in which said opening is partially closed by said deflector and a fully deflecting position in which the opening is substantially closed by the deflector; and an actuator operationally connected to one of said first or second cylinders and operationally associated with said deflector for moving the deflector and said one of said first or second cylinders between at least a first position in which said holes on the first and second cylinders are not aligned and the deflector is in the open position, at least one intermediate second position in which said holes on said first and second cylinders are partially aligned and the deflector is in the intermediate deflecting position, and a third position in which said holes on the first and second cylinders are fully aligned and the deflector is in the fully deflecting position.

22. A blow dryer comprising:

a body including a barrel having a barrel opening, said barrel comprising a plurality of holes;

a deflector positioned substantially within said barrel, said deflector being movable between at least an open position in which said barrel opening is opened, and a deflecting position in which said barrel opening is substantially closed;

an actuator operationally connected to said deflector for moving said deflector between at least said open position and said deflecting position; and a mesh-type screen surrounding said barrel so as to partially obstruct an air flow through the plurality of holes.

23. A blow dryer according to claim 22, further comprising a removable foam-type material surrounding said mesh-type screen on said barrel so as to increase the obstruction of air flow through said plurality of holes.

24. A blow dryer according to claim 23, wherein said foam type material is elastic.

25. A blow dryer comprising:

a body including a barrel having a barrel opening, said barrel comprising a plurality of holes;

a deflector positioned substantially within said barrel, said deflector being movable between at least an open position in which said barrel opening is opened, and a deflecting position in which said barrel opening is substantially closed;

an actuator operationally connected to said deflector for moving said deflector between at least said open position and said deflecting position; and a removable foam-type material surrounding said barrel so as to partially obstruct an air flow through the plurality of holes.

26. A blow dryer according to claim 25, wherein said foam-type material is elastic.

27. A blow dryer comprising:

a body including a barrel having a barrel opening, said barrel comprising a plurality of holes;

a deflector positioned substantially within said barrel, said deflector being movable between at least an open position in which said barrel opening is opened, and a deflecting position in which said barrel opening is substantially closed;

an actuator operationally connected to said deflector for moving said deflector between at least said open position and said deflecting position; and a mesh-type screen positioned cylindrically inside of said barrel so as to partially obstruct an air flow through said plurality of holes.

28. A blow dryer according to claim 27, further comprising a removable foam-type material surrounding said barrel so as to increase the obstruction of air flow through said plurality of holes.

29. A blow dryer according to claim 28, wherein said foam-type material is elastic.

30. A blow dryer comprising:

a body including a barrel having a barrel opening, said barrel comprising a plurality of holes;

a deflector positioned substantially within said barrel, said deflector being movable between at least an open position in which said barrel opening is opened, and a deflecting position in which said barrel opening is substantially closed;

an actuator operationally connected to said deflector for moving said deflector between at least said open position and said deflecting position; and a mesh-type screen integrated into each said plurality of holes so as to partially obstruct air flow through said plurality of holes.

31. A blow dryer according to claim 30, further comprising a removable foam-type material surrounding said barrel so as to increase the obstruction of air flow through said plurality of holes.

32. A blow dryer according to claim 31, wherein said foam-type material is elastic.

* * * * *